United States Patent [19]

Hashimoto

[11] Patent Number: 4,462,304

[45] Date of Patent: Jul. 31, 1984

[54] WIND-SHIFTING APPARATUS FOR AN AIR CONDITIONER

[75] Inventor: Yasuhiko Hashimoto, Shizuoka, Japan

[73] Assignee: Mitsubishi Denki Kabushiki Kaisha, Tokyo, Japan

[21] Appl. No.: 427,033

[22] Filed: Sep. 29, 1982

[30] Foreign Application Priority Data

Oct. 2, 1981 [JP] Japan ..... 56-146783[U]
May 6, 1982 [JP] Japan ..... 57-75733

[51] Int. Cl.[3] ..... F24F 13/10
[52] U.S. Cl. ..... 98/40 V
[58] Field of Search ..... 98/40 V, 40 VM, 94 R, 98/94 AC, 110, 121 A; 415/125

[56] References Cited

U.S. PATENT DOCUMENTS 3,330,202 7/1967 Del Colle ..... 98/40 V
3,577,905 5/1971 Nussdorfer et al. ..... 98/110 X
4,018,159 4/1977 Bennett ..... 98/121 A X

FOREIGN PATENT DOCUMENTS 25793 7/1973 Japan .
68745 6/1981 Japan ..... 98/121 A
654893 7/1951 United Kingdom ..... 415/125

*Primary Examiner*—Harold Joyce
*Attorney, Agent, or Firm*—Sughrue, Mion, Zinn, Macpeak & Seas

[57] ABSTRACT

A wind-shifting apparatus for an air conditioner has a plurality of pivotably supported wind-shifting plates disposed in front of a main body of the air conditioner for changing a direction and blow angle of wind emitted from the air conditioner main body. A drive source having a rotatable shaft is coupled to one of the wind-shifting plates through a movable plate and an arm which convert the rotary motion of the drive source into pivotable, rotary motion of one of the wind-shifting plates.

12 Claims, 12 Drawing Figures

WIND-SHIFTING APPARATUS FOR AN AIR CONDITIONER

BACKGROUND OF THE INVENTION

The present invention relates to a wind-shifting apparatus for changing the direction and blow angle of wind emitted from an air conditioner.

The location at which an air conditioner can be installed in a room is often restricted by the purposes for which the room is used, the arrangement of furniture, and so forth. In order to operate the air conditioner most efficiently, it is necessary to design it so that the direction and blow angle of wind emitted from the air conditioner can be changed and varied as desired.

SUMMARY OF THE INVENTION

It is an object of the present invention to provide an improved wind-shifting apparatus which is capable of selectively varying a direction and blow angle of wind emitted from an air conditioner easily and inexpensively.

The wind-shifting apparatus of the present invention comprises a plurality of wind-shifting plates which are all integrally movable; an arm which is rotatably connected to one end of one of the wind-shifting plates, the other end of the arm being provided with a connecting shaft; a driving means which provides rotary motion; and a movable plate which is provided with a plurality of holes on one end portion of the movable plate, said holes being chosen appropriately to receive the connecting shaft of the arm, and an opposite end of the movable plate having an elongated hole within it so that the rotary motion of a driving means can be converted into reciprocating motion by connecting the movable plate to the driving means through a crank, with one end of the crank inserted into the elongated hole of the movable plate.

DESCRIPTION OF THE PREFERRED EMBODIMENTS

Figure 1:
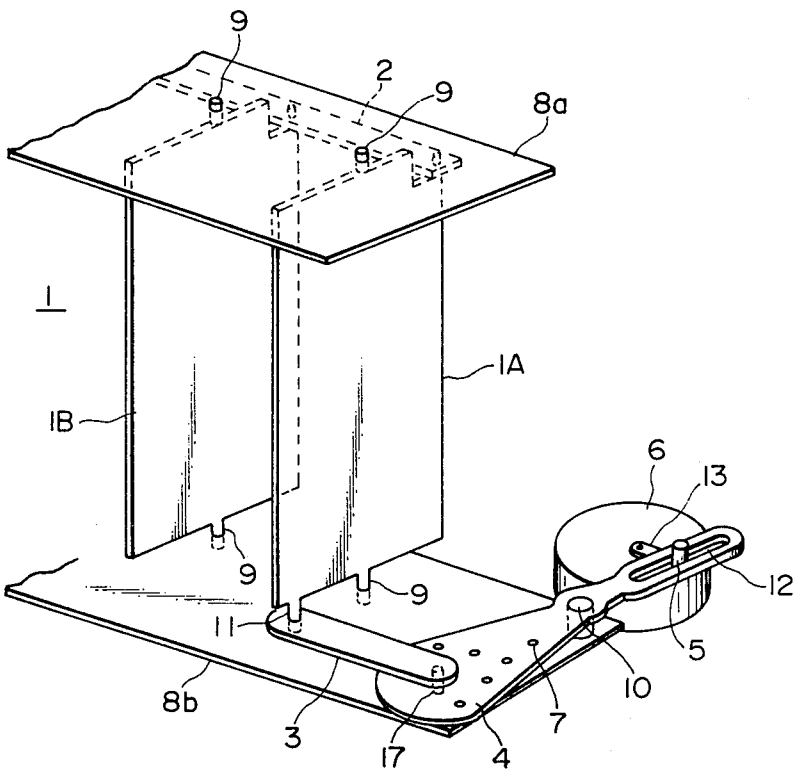
FIG. 1 is a perspective view of a first embodiment of a wind-shifting apparatus of the present invention.

Referring to FIG. 1, upper and lower frames 8*a*, 8*b* are provided at a blow outlet of an air conditioner (not shown). The frames 8*a*, 8*b* comprise a pair of supporting members which pivotally support a plurality of wind-shifting plates 1, two of which are identified as 1A and 1B in FIG. 1. The plates are rotatably secured to the frames 8*a* and 8*b* by supporting shafts 9, and the plates 1 are connected to each other by means of a connecting bar 2 so that all the wind-shifting plates are integrally movable. A driving shaft 11 extends from the bottom of a driving wind-shifting plate 1A, and the driving shaft 11 extends through a hole bored in one end of an arm 3 so that it is rotatably connected to the arm 3. A shaft 17 extends from the other end of the arm 3, and the shaft 17 is rotatably connected to a movable plate 4 by inserting the shaft 17 in one of a plurality of holes 7 in the movable plate 4. The positions of the holes 7 are determined by the length of the arm 3, the necessary angle of rotation of the wind-shifting plate 1, and so forth. The movable plate 4 is rotatably fixed to the frame 8*b* by means of a support 10, and an elongated hole 12 is bored through the opposite side of the movable plate 4. A pin 5 of a crank 13, which is attached to a low-speed rotary motor 6, is fitted through and slide within the elongated hole 12 so that it converts the rotary motion of the motor into the pivoting motion of the movable plate 4.

The function of the wind-shifting apparatus is explained below.

When the low-speed rotary motor 6 rotates, the crank 13 also rotates so that the pin 5 of the crank 13 slides in the elongated hole 12 of the movable plate 4, thus causing the movable plate 4 to pivot about the support 10. Since the arm 3 is connected through one of the holes 4 to the opposite side of the movable plate 4, the pivoting motion is transmitted as reciprocating motion to the arm 3, which causes the wind-shifting plate 1A to pivot about its support shafts 9. Accordingly, the direction of wind is automatically changed according to the rotation of the motor 6.

Figure 2:
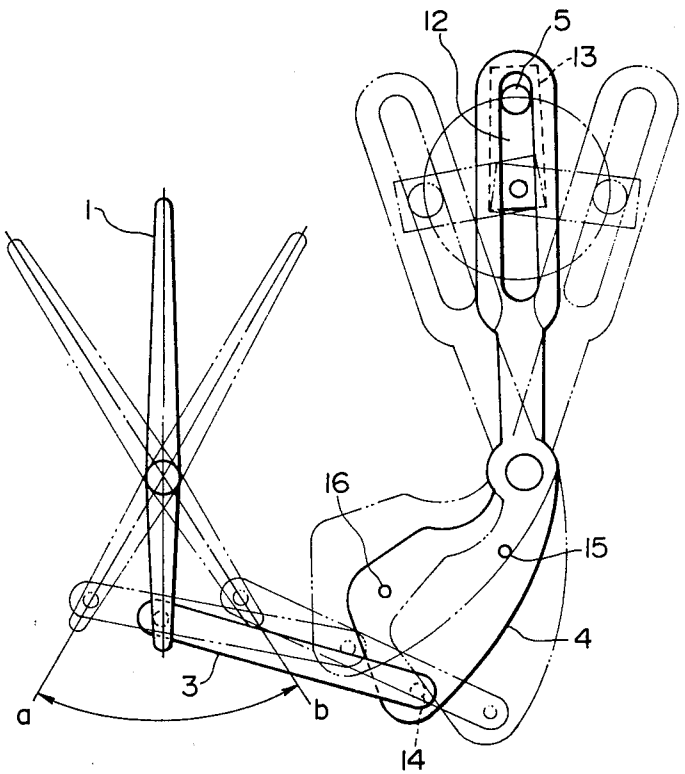
FIGS. 2 to 4 each illustrate the action of the wind-shifting apparatus and the direction and blow angle of wind for the apparatus of FIG. 1.
Figure 4:
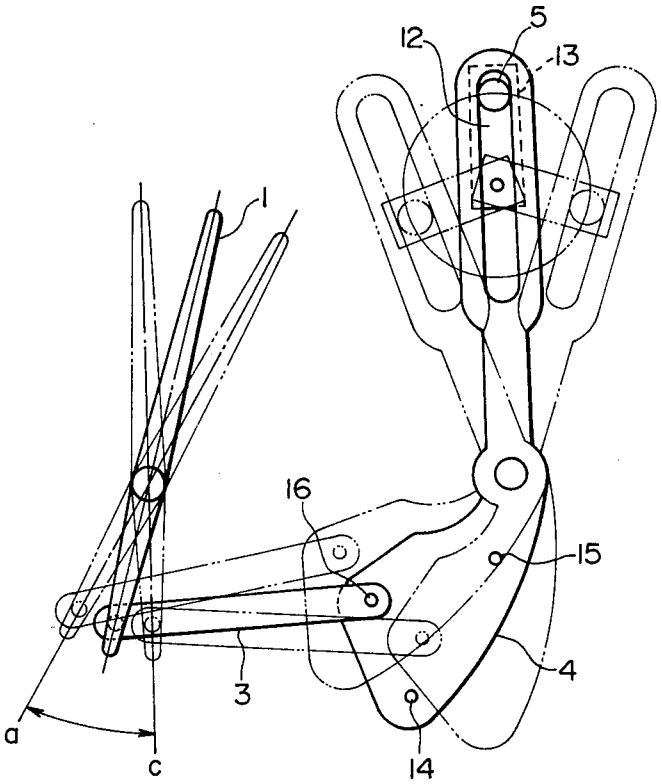
Figure 3:
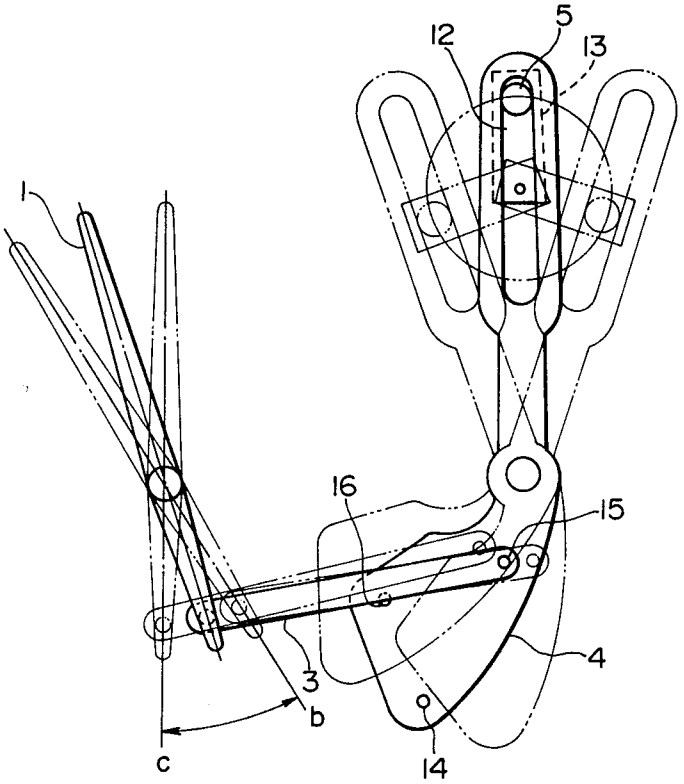

When the arm 3 is connected to a hole 14 which is bored into the top end of the movable plate 4, as illustrated in FIG. 2, the wind-shifting plate 1A moves within the a-b range, thus changing the direction mode of wind. Similarly, when the arm 3 is connected to a hole 15 which is bored near the support 10 of the movable plate 4, as illustrated in FIG. 3, the wind-shifting plate 1A moves within the b-c range, thus also changing the direction of wind. When the arm 3 is connected to a hole 16 which is bored into the left end of the movable plate 4, as illustrated in FIG. 4, the wind-shifting plate 1A moves within the a-c range, thus, again changing the direction of wind.

If it is desired to move the wind-shifting plate within the a-b range, such movement can be accomplished by boring a hole at a point within the triangle formed by the holes 14, 15 and 16 and connecting the arm 3 to the hole.

Since the wind-shifting apparatus of the present invention comprises a crank device which is used to convert rotary motion into reciprocating motion, a movable plate with a plurality of holes bored within it, and an arm connected to a wind-shifting plate, the wind-shifting apparatus of the present invention is inexpensive. Furthermore, the direction and blow angle of wind can be easily varied by using the wind-shifting apparatus of the present invention.

Another embodiment of the present invention is shown in FIGS. 5–9. According to the embodiment shown in these figures, the frames 8*a* and 8*b*, which are placed at the blow outlet of an air conditioner; a wind-shifting plate 1; a connecting bar 2; an arm 3; a movable plate 4; a low-speed rotary motor 6; etc., have the same construction as those shown in FIG. 1. A shaft 17 of the arm 3 comprises a small diameter portion 21 and a large diameter portion 22. A plurality of small holes 18 are bored in the movable plate 4 and are connected to a large hole 19 which is bored in the central portion of the movable plate 4 through groove or slit 20. The large hole 19, which is bored at the central portion, is designed so that the large diameter portion 22 of the shaft 17 can pass therethrough. The diameter of the small holes 18 is determined so that the small hole 18 comes into engagement with the small diameter portion 21 of the shaft 17. The diameter of the small holes 18 permits the small diameter portion 21 of the shaft 17 to be smoothly rotatable without rattling. The small diameter portion 21 of the shaft 17 is urged to fit with the small hole 18 through the groove 20. The width of the grooves or slits 20 which connect the small holes 18 to the large hole 19 is made smaller than the small diameter portion 21 of the shaft 17 to thus prevent the shaft 17 from release. In bringing the arm 3 into engagement with the movable plate 4, the shaft 17 of the arm 3 is inserted into the large hole 19, which is bored at the central portion, and moved toward the small hole 18, which lies in approximately the same plane as the large hole 19. At this time, since the movable plate 4 is made of resilient plastic material, the groove 20 is deformed and broadened when the shaft 17 is pushed into it. When the shaft 17 is completely fitted through the small hole 18, the groove 20 returns to its original form. Accordingly, the shaft 17 of the arm 3 cannot be released from the hole 18, in spite of the frictional forces which are generated and transmitted to the shaft 17 by the pivoting of the wind-shifting plates 1 and the forces created by wind resistance.

Figure 5:
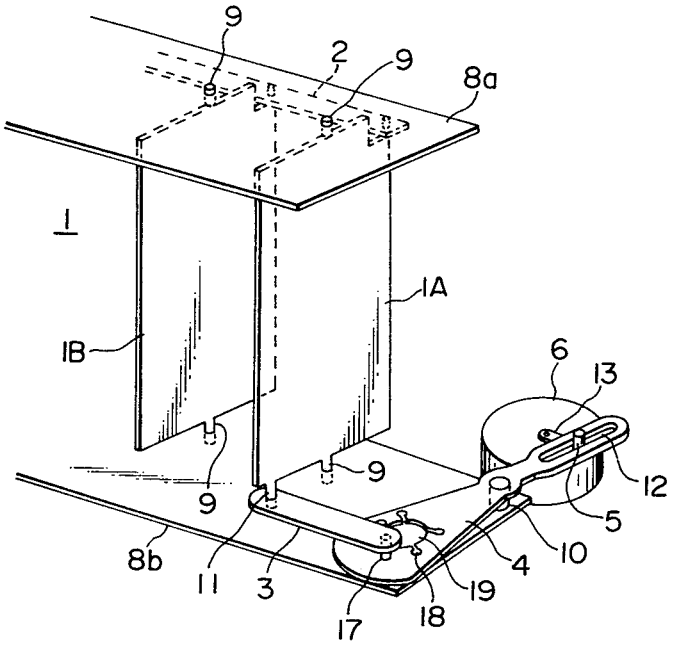
FIG. 5 is a partial perspective view illustrating a second embodiment of a wind-shifting apparatus of the present invention.
Figure 6:
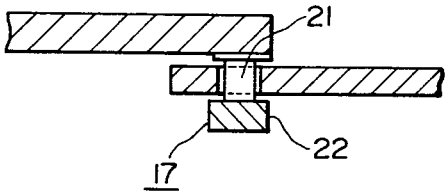
FIG. 6 is a cross-sectional view illustrating the connecting portion between an arm and a movable plate in the apparatus of FIG. 5.
Figure 7:
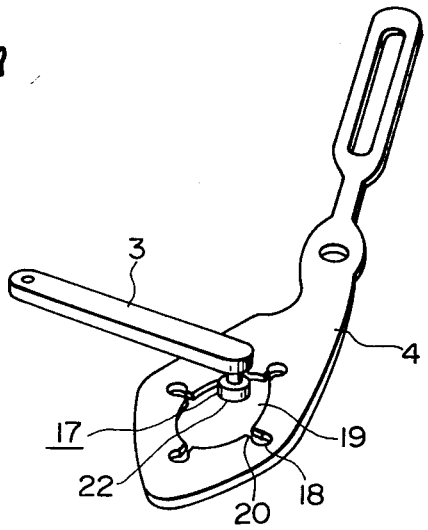
FIG. 7 is an enlarged perspective view showing the movable plate and the arm of FIGS. 5 and 6.
Figure 9:
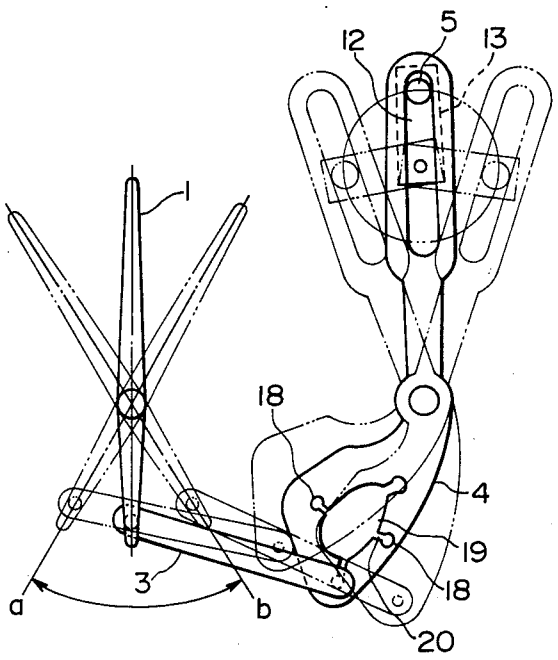
FIGS. 8 and 9 each illustrate the action of the wind-shifting apparatus of FIGS. 5–7.
Figure 8:
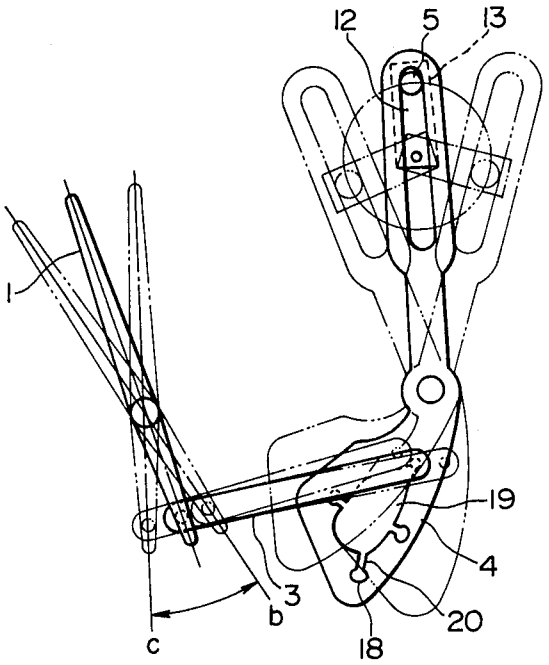

The function of the wind-shifting apparatus shown in FIG. 5 is almost the same as that of the apparatus shown in FIG. 1 except that, when it is desired to change the direction of wind in the apparatus of FIG. 5, it is sufficient to remove the shaft 17 from one small hole 18 and place it into another small hole 18, as is apparent from FIG. 7. Therefore, linkage between the arm and the shaft is easily carried out, and the linking position therebetween is easily changeable in accordance with the installing condition of the air conditioner to obtain optimum wind direction, and that the simple construction results, so that optimum wind direction and blowing angle is obtainable at low cost. Since the driving force can be surely transmitted from the motor to the wind-shifting plate in the apparatus shown in FIG. 5 without disengagement between the arm and shaft, the effect of the present invention is further improved.

Next, the structure for supporting the reciprocating, pivotal wind-shifting plate will be described with reference to FIGS. 10 and 12 according to another preferred embodiment of the present invention.

Figure 10:
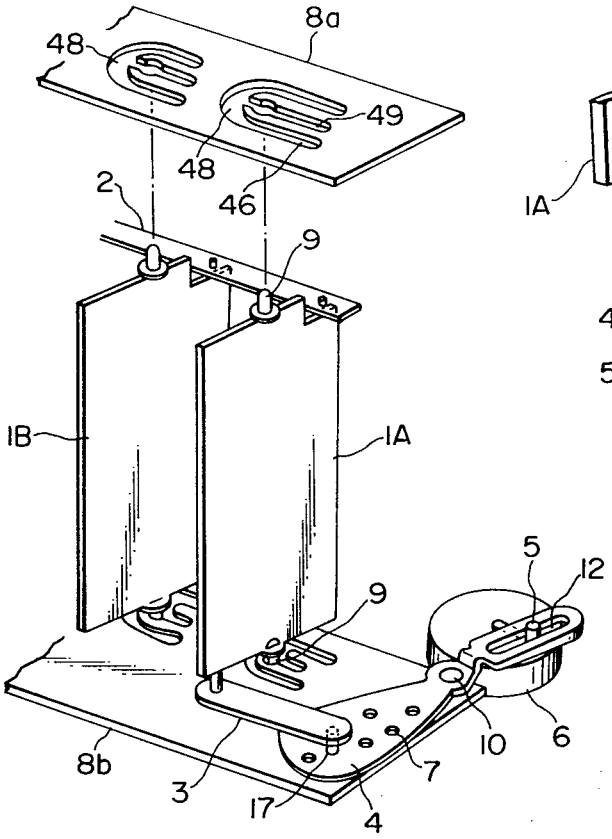
FIG. 10 is a schematic, perspective view of a third embodiment of a wind-shifting apparatus of the present invention.
Figure 11:
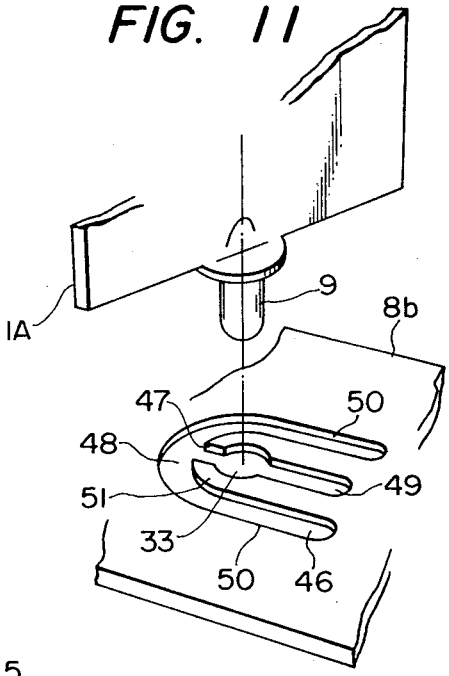
FIG. 11 is an enlarged perspective view of a part of FIG. 10.

As illustrated in FIGS. 10 and 11, a plurality of bearing holes 33 are bored at predetermined intervals in the upper and lower bearing plates 8*a* and 8*b*. These bearing plates are to be placed at the blow outlet of the air conditioner (not shown), and a plurality of wind-shifting plates 1A, 1B, each being provided with supporting shafts 9 at their upper and lower ends, are rotatably supported on the bearing plates 8*a* and 8*b* by engagement of the supporting shafts in the bearing holes 33. The bearing holes 33 are made slightly smaller than the diameter of the supporting shafts 9. These wind-shifting plates are connected to each other by a connecting bar 2 which is mounted on the top of the plates. At least one of the wind-shifting plates 1A is connected to a low-speed rotary motor 6 through an arm 3 and a movable plate 4, with a support 10 provided thereto. The movable plate 4 is connected to the arm 3.

As in the other embodiment, an elongated hole 12 is provided in the movable plate 4, and a crank pin 5 is engaged with the elongated hole 12. The crank pin 5 is connected to the low-speed rotary motor 6. A pin 17 is provided on the arm 4 and is brought into engagement with a plurality of pin holes 7, which are bored into the movable plate 4 so that the arm 3 and the movable plate 4 are connected to each other.

A plurality of U-shaped grooves 46 are bored in the upper and lower bearing plates 8*a* and 8*b*. The U-shaped grooves surround and are spaced apart from bearing holes 33. The diameter of the bearing holes 33 is less than the diameter of the supporting shafts. A plurality of notched grooves 47 (FIG. 11) connect the bearing holes 33 to the bottom portions 48 of the U-shaped grooves 46, and a slit 49 extends from each of the bearing holes 33 in the opposite direction of the corresponding notched grooves 47. The slit 49 is parallel with a straight portion 50 of the U-shaped groove 46, and, accordingly, an elastic supporting arm 51 is formed.

Since the diameter of the bearing holes 33 is made smaller than the diameter of the supporting shafts 9, the supporting arms 51 are urged apart when the supporting shaft 9 is inserted into the hole 33 to securely hold the supporting shaft 9. When the low-speed rotary motor 6 is operated, the arms 3 are moved back and forth in the same manner as in the other embodiments, and this motion is transmitted to the wind-shifting plate 1A. In this way, the wind from a blower (not shown) is automatically shifted according to the rotation of the low-speed rotary motor 6. In this embodiment, if the wind-shifting plates 1A, 1B begin to vibrate from the wind pressure of the blower, the vibration are absorbed by the supporting arms 51 which form the bearing holes 33, and no unpleasant noise develops. Furthermore, no excess friction develops between the supporting shaft and the bearing hole due to the resiliency of the supporting arms 51.

Figure 12:
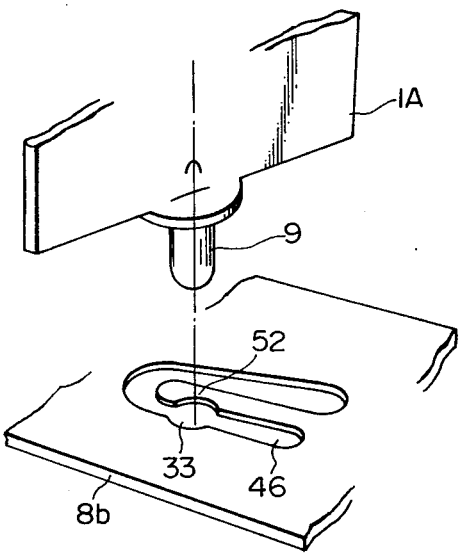
FIG. 12 is a dismantled, perspective view of a modification of the wind-shifting apparatus of FIGS. 10 and 11.

FIG. 12 shows a modification of the embodiment of FIGS. 10 and 11. In FIG. 12, half of the U-shaped groove 46 has been eliminated so that only one resilient supporting arm 52 is formed adjacent to the bearing hole 33. Again, the diameter of the bearing hole 33 is smaller than the diameter of the supporting shaft 9 so that the supporting arm 52 can resiliently hold the supporting shaft 9 and dampen vibrations.

I claim:

1. A wind-shifting apparatus for an air conditioner, comprising:

a plurality of wind-shifting plates;

means for pivotally supporting said wind-shifting plates in front of a main body of said air conditioner;

a drive source having a rotary shaft which provides rotary motion;

a movable plate connected to said rotary shaft;

a support for pivotably securing said movable plate at a point between opposite ends thereof, said movable plate having converting means at one end thereof connected to said rotary shaft for converting said rotary motion of said rotary shaft into pivotable motion of said movable plate about said support, an opposite end of said movable plate having a plurality of holes therein;

an arm having a shaft engaged with one of said plurality of holes in said opposite end of said movable plate; and means for connecting said arm to one of said plurality of wind-shifting plates so that said rotational motion of said drive shaft pivotably rotates said one of said plurality of wind-shifting plates to change a direction of wind being blow from said air conditioner main body.

2. The apparatus as claimed in claim 1 further comprising means for interconnecting said plurality of wind-shifting plates so that said plurality of wind-shifting plates pivotably rotate together.

3. The apparatus as claimed in claim 2 wherein said interconnecting means comprises a connecting bar.

4. The apparatus as claimed in claim 2 wherein said pivoting supporting means comprises upper and lower frame members and a plurality of supporting shafts which extend from upper and lower ends of said plurality of plates, said plurality of supporting shafts being pivotably coupled to said upper and lower frame members.

5. The apparatus as claimed in claim 1 wherein said plurality of holes in said opposite end of said movable plate are positioned to provide varying angles of rotation of said one of said plurality of wind-shifting plates, said plurality of holes being in substantially a common plane.

6. The apparatus as claimed in claim 4 wherein said support is connected to said lower frame member.

7. The apparatus as claimed in claim 1 wherein said drive source comprises a low-speed electric motor.

8. The apparatus as claimed in claim 1 wherein said converting means comprises an elongated slot formed in said movable plate, and a crank having a pin engagable with said elongated slot, said crank having one end coupled to said rotary shaft.

9. The apparatus as claimed in claim 5 wherein said plurality of holes in said opposite end of said movable plate are each connected to a large connecting hole by a plurality of slits having a width slightly smaller than a diameter of said shaft of said arm.

10. The apparatus as claimed in claim 9 wherein said plurality of holes in said movable plate are formed around said large connecting hole.

11. The apparatus as claimed in claim 10 wherein said shaft of said arm has a small diameter portion and a large diameter portion, a diameter of said small diameter portion being slightly greater than said width of said plurality of slits, a diameter of said large diameter portion being larger than a diameter of said plurality of holes in said movable plate.

12. The apparatus as claimed in claim 11 wherein said diameter of said large diameter portion is less than a diameter of said large connecting hole.

* * * * *